United States Patent [19]

Yashiki

[11] Patent Number: 4,620,996

[45] Date of Patent: Nov. 4, 1986

[54] COATING DEVICE AND COATING METHOD BY USE THEREOF

[75] Inventor: Yuichi Yashiki, Yokohama, Japan

[73] Assignee: Canon Kabushiki Kaisha, Tokyo, Japan

[21] Appl. No.: 758,841

[22] Filed: Jul. 25, 1985

Related U.S. Application Data

[63] Continuation of Ser. No. 573,576, Jan. 25, 1984, abandoned.

[30] Foreign Application Priority Data

Jan. 27, 1983 [JP] Japan ..... 58-12257
Sep. 12, 1983 [JP] Japan ..... 58-142036[U]

[51] Int. Cl.[4] ..... B05D 1/18
[52] U.S. Cl. ..... 427/430.1; 118/429
[58] Field of Search ..... 427/430.1; 118/429

[56] References Cited

U.S. PATENT DOCUMENTS 2,165,364 7/1939 Ferngren ..... 118/429
4,204,498 5/1980 Iuancic ..... 427/430.1
4,448,798 5/1984 Kageyama et al. ..... 427/430.1

FOREIGN PATENT DOCUMENTS 204105 12/1954 Australia ..... 427/430
709572 5/1954 United Kingdom ..... 118/429

*Primary Examiner*—Shrive P. Beck
*Attorney, Agent, or Firm*—Fitzpatrick, Cella, Harper & Scinto

[57] ABSTRACT

A coating device was provided for coating an object to be coated with a paint by dipping the object into a coating bath containing a paint, which comprises a member for uniformizing the flow of a paint gushing out from the lower part of the coating bath toward the upper part thereof, the member being provided in the coating bath at a lower part thereof. Coating was carried out with the coating device.

5 Claims, 9 Drawing Figures

COATING DEVICE AND COATING METHOD BY USE THEREOF

This application is a continuation of application Ser. No. 573,576 filed Jan. 25, 1984 abandoned

BACKGROUND OF THE INVENTION

1. Field of the Invention

This invention relates to a coating device which can uniformize the thickness and the composition of a coating to be formed by providing a member for uniformizing the flow of a paint gushing out into a coating bath and also to a coating method by use of said coating device.

2. Description of the Prior Art

Dip coating, which comprises dipping an object to be coated in a coating bath containing a paint and withdrawing the dipped object, is a coating method which has widely been employed. In this method, a coating bath of any desired shape may be used. A paints is charged in a coating bath, and in order to prevent nonuniformity of concentration of a paint or to prevent drying of the liquid surface of the paint, it is more preferable to gush out the paint upward from the inlet at the lower point of a coating bath to permit the paint to overflow from the bath rather than letting the paint stay in the bath, as disclosed in U.S. Pat. Nos. 2,808,344 and 3,046,156. Also, in this case, unevenness of coating is reduced by feeding constantly a paint to a coating bath to overflow continuously rather than by permitting it to overflow only at the time when a coating object is dipped in a paint.

In the method for feeding continuously a paint to a coating bath, it is reasonable to collect the overflowing paint and return it to the coating bath. As an improvement of this method, for the purpose of preventing fluctuations of the liquid surface in the coating tank, making the paint preparation easy and further retaining uniformity of the paint, it is proposed to provide additionally another tank separated from the coating bath and circulate the paint therebetween, as disclosed in Japanese patent application No. 200909/1982. The method is shown in FIG. 1. More specifically, a paint 7 is pressurized by means of a pump 8, filtered through a filter 9 and fed through a feeding inlet 10 into a coating bath 2, and the paint 7 is gushed out upward from the feeding inlet at the lower part of the coating bath to overflow and is collected in a receiving tray 4 before it is returned through a pipe 5 to the coating tank.

According to this method, the paint fed into the coating bath is desired to form a uniform and smooth flow around a material to be coated in the coating bath 2. In other words, the paint fed into the coating bath, which flows through a feeding inlet into the bath at a certain flow velocity, may agitate the paint in the bath or ripple the liquid surface of the paint when flowing linearly through the feeding inlet into the coating bath, whereby unevenness of the coating may be caused to occur. For example, when uniformity of film thickness contributes largely to electrophotographic characteristics as in the case of a photosensitive layer of an electrophotographic photosensitive member, it is supremely important to remove the unevenness.

Also, in the case when the surface of an object of which one end portion is opened and the other end portion is closed, is coated with a paint, and the object to be coated is dipped in the paint, a slight temperature difference between the paint and the ambience may frequently result in expansion of the air enclosed in the object or increase of gas volume by evaporation of the solvent of the coating liquid into the hollow of the coating object, thereby causing formation of a bubble from the lower end in the course of withdrawal of the object. The coating liquid will be moved greatly by generation of such a bubble to form unevenness on the coated surface, thus causing inconvenience in formation of a uniform coating.

In order to prevent such a trouble, it is proposed to remove a part of the air enclosed in the coating object in the coating step, as disclosed in Japanese patent application No. 173558/1981 (Japanese Laid-open Publication No. 74170/1983). This method is shown in FIG. 2, and the principle comprises removing only a part of the air enclosed in the object to be coated by means of an air pipe 14. More specifically, a screw 17 rotates by means of a motor 18 and the object to be coated held by a holding member 16 is drawn up. In the step of drawing up, for the purpose of preventing the bubble from inside the hollow from being released into a paint 13 contained in a coating bath 12 by rise of the pressure in the hollow of the object to be coated, a part of the air in the hollow of the object to be coated is permitted to be removed through an air pipe 14 connected to an air chamber made of a rubber.

SUMMARY OF THE INVENTION

A primary object of the present invention is to provide a coating device which can prevent an occurrence of uneven coating through disturbance of the state of a paint in a coating bath by the paint entering there.

It is also another object of the present invention to provide a coating device in which an air pipe is used in combination, whereby no bubble will be released from the hollow of a coating object and nonuniformity of a paint concentration will not occur.

Still another object of the present invention is to provide a coating method of forming a coating having a uniform thickness and a uniform composition.

According one aspect of the present invention, there is provided a coating device for coating an object to be coated with a paint by dipping the object into a coating bath containing a paint, which comprises a member for uniformizing the flow of a paint gushing out from the lower part of the coating bath toward the upper part thereof, the member being provided in the coating bath at a lower part thereof.

According to another aspect of the present invention, there is provided a method for coating an object to be coated with a paint by dipping the object in a coating bath containing a paint, which comprises dipping the object to be coated in the coating bath while the flow of a paint gushed out from the lower part of the coating bath toward the upper part thereof is uniformized by means of a member for uniformizing the flow of the paint.

DESCRIPTION OF THE PREFERRED EMBODIMENTS

Figure 3:
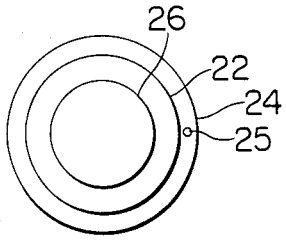
FIG. 3 is a plan view of a coating bath of the present invention and FIG. 4 is a side elevational view thereof.
Figure 4:
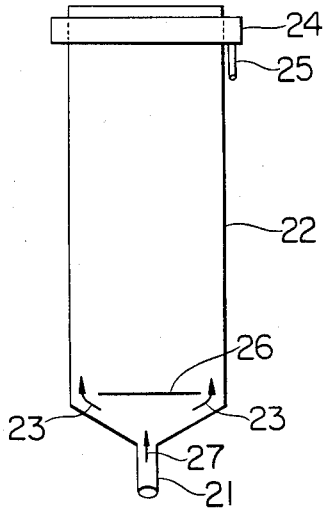

FIG. 3 and FIG. 4 show a typical example of a coating bath of the coating device of the present invention.

FIG. 3 is a plan view of the coating bath, and FIG. 4 is its side elevational view. 22 is a cylindrical coating bath, and a feeding inlet 21 for paint inflow is provided at the lower part thereof. Upward inflow of the paint as shown by an arrowhead 27 rather than horizontal inflow is chosen for better uniformization of the flow. A receiving tray 24 is provided for the purpose of recovery of the paint overflowing from the coating bath. 26 is a disc, which is a member for uniformizing the flow of the paint. The disc 26 may preferably be apart from the tip of the feeding inlet by a distance longer than the outer diameter of the feeding inlet so that it may not disturb the flow of the paint from the feeding inlet. However, it is not necessary to take too long a distance, but a distance less than the outer diameter of the coating bath may be satisfactory. The disc may preferably have a size equal to or greater than the outer diameter of the object to be coated. Thus, the paint fed will flow upward smoothly along the inner wall of the coating bath as shown by the arrowhead 23, whereby nonuniformity will not be formed. In the case when a cone is used in place of a disc, it is preferred to arrange the cone with its apex being at the lower side.

As the member for uniformizing the flow of the paint, in addition to the disc or cone as described above, there may suitably be employed a member which is circular or has a circular cross-section as viewed from the direction in which the paint is gushed out, namely from the lower part of the coating bath to the upper part. Such a member may have a shape of a sphere, a semispheres, a spheriodal body or a spindle.

The coating method by using the coating device according to the present invention may preferably be practiced by dipping an object to be coated into a coating bath while the flow of the paint gushing out from the lower part of the coating bath toward the upper part is uniformized by means of a member for uniformizing the flow of the paint. Alternatively, the flow of the paint may be uniformized when an object to be coated is not dipped in the coating bath, and the flow of the paint may be stopped during dipping.

Figure 5A:
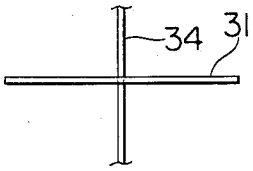
FIGS. 5, *a*, *b* and *c* are each sectional view of the member for uniformizing the flow of the paint in the coating bath of the present invention.
Figure 5B:
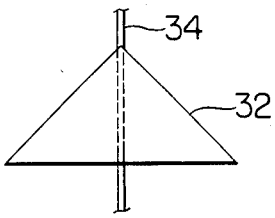
Figure 5C:
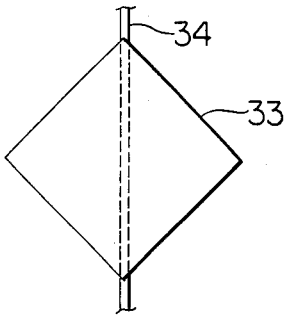

In the case of applying a paint on the surface of an object to be coated, having one end which is opened and the other end which is closed, by way of dip coating, it is preferred to use a coating device having an air pipe as described above extending through the coating bath vertically from the lower part to the liquid surface of the paint, arranged together with the member for uniformizing the flow of the paint. In this case, the air pipe and the member for uniformizing the flow of the paint may be provided separately from each other. More preferably, however, as shown in FIG. 5, the member for uniformizing the flow of a paint may be mounted on the air pipe. In FIG. 5, a is a disc 31, b a cone 32 and c a spindle, each being mounted on the air pipe 34 as the member for uniformizing the flow of the paint.

Figure 1:
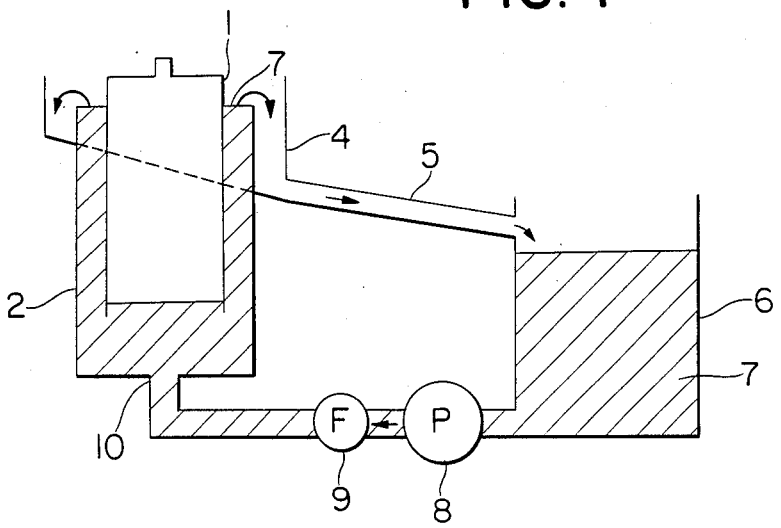
FIG. 1 is a schematic illustration of a coating device for circulating a paint between a coating bath and a paint tank.
Figure 6:
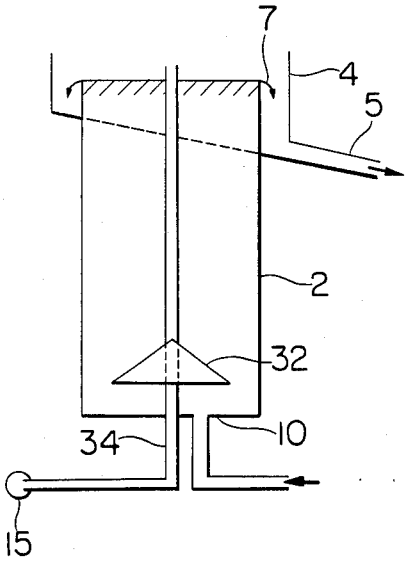
FIG. 6 and FIG. 7 are each sectional view of the coating bath in the coating device according to the present invention.

FIG. 6 is a sectional view of a coating bath when the air pipe 34 equipped with the cone 32 is mounted to the coating bath as shown in FIG. 1. The air pipe and the cone may be made of any material which is not corroded or denatured by a paint, such as plastics, aluminum, brass, stainless steel, copper, and nickel.

Figure 2:
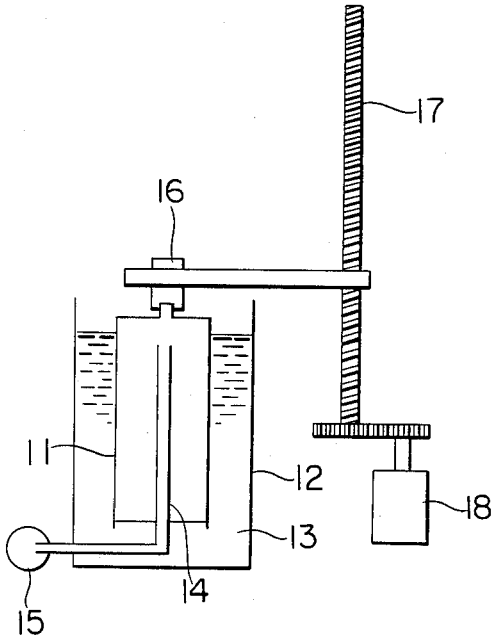
FIG. 2 is a schematic illustration of a coating device having an air pipe.

The whole assembly of the coating device can be completed by mounting a means for circulating the paint as shown in FIG. 1 and a means for drawing up the object to be coated as shown in FIG. 2.

Figure 7:
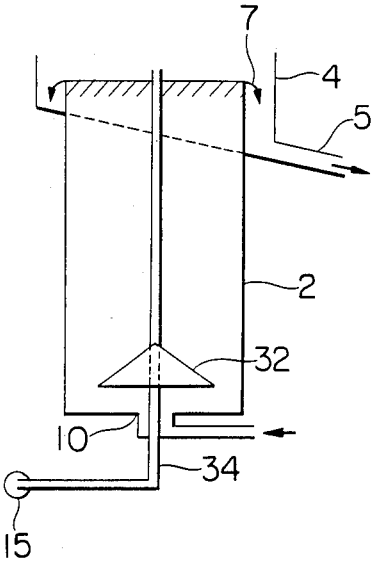

Alternatively, it is also effective to provide a feeding inlet 10 at a position concentric with the air pipe, as shown in FIG. 7.

By coating by means of the coating device according to the present invention as described above, a very beautiful coating free from unevenness can be formed.

The present invention is described in detail by referring to the following Example.

EXAMPLE 1

A coating bath of an inner diameter of 10 cm and a height of 35 cm having a shape as shown in FIG. 3 and FIG. 4 was made, the bottom portion being made conically shaped with an apex angle of 140°, and the apex portion being provided with an inlet for feeding a paint. Also, a disc of a diameter of 5 cm was mounted at a position 5 cm above the feeding inlet. The feeding inlet had a sectional area of 1.3 $cm^2$.

Then, 10 parts (parts by weight, hereinafter the same) of a disazo pigment of the structural formula:

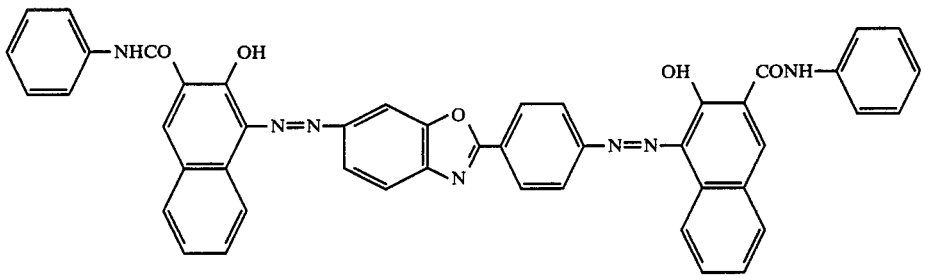

6 parts of cellulose acetate butyrate resin (trade name: CAB-381, produced by Eastman Chemical Co.) and 60 parts of cyclohexanone were dispersed in a sand mill device for 20 hours by use of glass beads of 1 mm in diameter. A paint was made by adding 100 parts of methyl ethyl ketone to the resultant dispersion. This paint was permitted to flow at a flow rate of 0.7 liter/-min. by means of a magnet pump and the overflowing paint was collected to the pump for recycling. The flow velocity at the feeding inlet was 9.0 cm/sec.

Into the coating device was dipped an aluminum cylinder of an outer diameter of 8 cm and a length of 30 cm applied with a subbing treatment with casein of 2 μ thickness, which was in turn withdrawn at a speed of 8 cm/min. to form a layer of 0.08 μ thickness. The film thickness was found to be uniform, which was confirmed by absence of unevenness of color in the pigment layer.

In contrast, when coating was applied in a coating bath having provided no disc, the liquid flow into the tank flowed upward linearly due to absence of the disc to overflow preferentially without mixing well with the surrounding liquid, whereby the concentration became gradually nonuniform in the coating bath. As a result, unevenness were formed on the coating obtained.

Then, 10 parts of a hydrazone compound of the structural formula shown below:

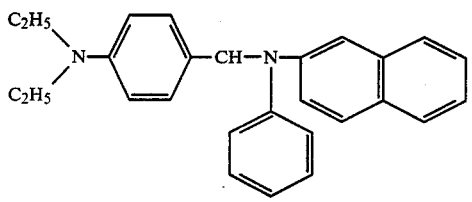

and 15 parts of a styrene-methyl methacrylate copolymer (trade name: MS-200, produced by Seitetsu Kagaku Co.) were dissolved in 100 parts of toluene to prepare a paint, which was then fed to a coating device of the same shape and circulated at a flow rate of 0.4 liter/min. The velocity at the feeding inlet was found to be 5.1 cm/sec.

Using this device, the cylinder already applied with the pigment layer was dipped and withdrawn at a speed of 6 cm/min. to form a layer of a thickness of 15 μ. The electrophotographic member thus prepared was mounted on a certain electronic copying device. The copied image obtained was found to be good. In contrast, when copying was conducted by using the electrophotographic member prepared from the cylinder applied with a pigment layer having nonuniformity, the density unevenness was also generated in the copied image to give only unclear images.

EXAMPLE 2

An aluminum cylinder like the one shown as 1 in FIG. 1 was provided as a substrate, which has an outside diameter of 60 mm, a thickness of 0.5 mm and a length of 260 mm, and has a closed top end and open bottom end.

A paint is prepared by dissolving 2 weight parts of Nylon copolymer (trade name: CM 8000, supplied by Toray Co., Ltd.) and 2 weight parts of Type 8 Nylon (trade name: EF 30T, supplied by Teikoku Kagaku Co.) into the mixture of 50 weight parts of methanol and 45 weight parts of toluene.

The coating apparatus is like the one shown in FIG. 7 and comprises a coating bath having an inside diameter of 80 mm and a height of 400 mm from the feeding inlet 10, provided with an air pipe 34 which projects out by 8 mm from the painting liquid surface, and a conical member of 60 mm in diameter and 25 mm in height was mounted on the air pipe at the level 30 mm higher than the feeding inlet 10. The paint is circulated at the flow velocity of 10 cm/sec. at the inlet.

The air chamber was so adjusted that approximately 50 ml of the air in the cylinder is discharged when it is dipped in the paint, leaving the top part of 8 mm in height undipped.

After the dipping, the substrate was raised at the rate of 120 mm/sec., and the coating was dried for 10 minutes at 50° C. Thus the uniform undercoat layer 0.5 μ thick was formed.

For comparison, coating was carried out by using the coating bath without an air pipe like that shown in FIG. 4. In this case, a bubble was evolved from the bottom of the substrate when the substrate was raised by approximately 80 mm. The bubble ripped the surface of the paint when it broke to result in the considerable unevenness of the coating. This phenomenon was coated by the evaporative methanol used as a component of the solvent.

Onto the uniform undercoat prepared above, disazo pigment layer and hydrazone compound layer was formed in the same manner as in Example 1, and was mounted on an electrophotographic photosensitive member. The copied image obtained was satisfactory.

On the other hand, the electrophotographic member prepared by employing a nonuniform undercoat layer gave uneven density in the images corresponding the unevenness of the undercoat layer.

What I claim is:

1. A coating device for coating an object to be coated with a paint by dipping the object into a coating bath containing a paint, which comprises (i) a coating bath; (ii) a feeding inlet for feeding a paint into the lower part of the coating bath; and (iii) a member for uniformizing the upward flow of a paint out from the lower part of the coating bath toward the upper part thereof, the member being provided in the lower part of the coating bath and above said feeding inlet to intercept and direct the upward flow of the paint along the entire wall periphery of the coating bath and provide a uniform and smooth flow of paint around each portion of the object immersed in said coating bath.

2. A coating device according to claim 1, wherein the member for uniformizing the flow of a paint is circular or has a circular cross-section as viewed from the direction of the upward flow of the paint.

3. A coating device according to claim 1, wherein an air pipe is disposed extending from the lower part of the coating bath to the liquid surface of the paint.

4. A coating device according to claim 3, wherein the member for uniformizing the flow of a paint is provided on the air pipe in the vicinity of the bottom of the coating bath.

5. A method for coating an object to be coated with paint by dipping the object in a coating bath containing a paint, which comprises (i) feeding paint into the lower part of the coating bath; (ii) dipping the object to be coated in the coating bath; and (iii) uniformizing the upward flow of the paint from the lower part of the coating bath toward the upper part thereof by means of a uniformizing member provided in the lower part of the coating bath to direct the upward flow of the paint along the entire wall periphery of the coating bath and provide a uniform and smooth flow of paint around each portion of the object immersed in said coating bath.

* * * * *